US006349728B1

(12) United States Patent
Pham

(10) Patent No.: US 6,349,728 B1
(45) Date of Patent: Feb. 26, 2002

(54) PORTABLE CIGARETTE SMOKING APPARATUS

(75) Inventor: Xuan M. Pham, Glen Allen, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/563,297

(22) Filed: May 3, 2000

(51) Int. Cl.[7] ..... A24F 3/00; A24F 19/10; A24D 1/12

(52) U.S. Cl. ..... 131/185; 131/175; 131/234; 131/235.1; 131/256

(58) Field of Search ..... 131/175, 185, 131/194, 231, 234, 235.1, 256, 349

(56) References Cited

U.S. PATENT DOCUMENTS

| | | | | |
|---|---|---|---|---|
| 3,242,700 A | | 3/1966 | Fukal | |
| 4,066,088 A | * | 1/1978 | Ensor | 131/185 |
| 4,233,998 A | | 11/1980 | Radey, Jr. | |
| 4,247,283 A | | 1/1981 | Vidas | |
| 4,694,841 A | | 9/1987 | Esparza | |
| 4,774,970 A | | 10/1988 | Bell | |
| 4,854,331 A | | 8/1989 | Banerjee et al. | |
| 4,856,981 A | | 8/1989 | Flangan | |
| 4,891,003 A | | 1/1990 | Ishiguro | |
| 4,993,435 A | | 2/1991 | McCann | |
| 5,127,822 A | | 7/1992 | Nakayama et al. | |
| 5,179,966 A | | 1/1993 | Losee et al. | |
| 5,274,214 A | | 12/1993 | Blackburn | |
| 5,479,948 A | | 1/1996 | Counts et al. | |
| 5,529,078 A | | 6/1996 | Rehder et al. | |
| 5,932,940 A | | 8/1999 | Epstein et al. | |

FOREIGN PATENT DOCUMENTS

| | | |
|---|---|---|
| EP | 0858744 A1 | 8/1998 |

* cited by examiner

*Primary Examiner*—Christopher A. Fiorilla
*Assistant Examiner*—Dionne A. Walls
(74) *Attorney, Agent, or Firm*—Burns, Doane, Swecker & Mathis, LLP

(57) ABSTRACT

A puff-on-demand cigarette smoking apparatus for decreasing unnecessary tobacco burning as well as decreasing the generation of side stream smoke. The portable cigarette smoking apparatus can be used to smoke traditional cigarettes and includes a reusable lighter box housing including an aperture into which an end of a cigarette to be smoked is adapted to be inserted into. After the cigarette is inserted through the aperture, the cigarette is directed into a cigarette extinguishing sleeve. The cigarette smoking system includes an actuable trigger which is operably connected to a cigarette advancing mechanism for advancing the cigarette a preset distance along the cigarette extinguishing sleeve into the lighter box housing upon actuation of the trigger. As a result, a portion of the cigarette is advanced beyond the cigarette extinguishing sleeve. Actuation of the trigger also activates a heat source to temporarily provide heat to the exposed portion of the cigarette, thereby lighting the cigarette and allowing the smoker to take a puff from end of the cigarette protruding the lighter box housing. At the end of a puff, the cigarette extinguishing sleeve is capable of extinguishing the cigarette. Actuation of the trigger can be repeated a plurality of times until no more tobacco rod of the cigarette is available for smoking. At the conclusion of smoking, the remaining cigarette can be removed from the lighter box housing and discarded.

23 Claims, 3 Drawing Sheets

PORTABLE CIGARETTE SMOKING APPARATUS

FIELD OF THE INVENTION

The present invention generally relates to a cigarette smoking apparatus. More particularly, the present invention pertains to a puff-on-demand portable cigarette smoking apparatus which is capable of decreasing unnecessary tobacco burning as well as decreasing the generation of side stream smoke.

BACKGROUND OF THE INVENTION

Generally, when a smoker lights up and smokes a cigarette, the cigarette is continually burned and the smoker only consumes a relatively small portion of the cigarette. In fact, many cigarettes are treated so as to insure a uniform continual burning when the cigarette is not being smoked. As a result, a large amount of the tobacco is unnecessarily burned and wasted during the smoking of a traditional cigarette. In addition, by continuously burning the cigarette, a large amount of smoke is unnecessarily generated, further exposing the non-smoking public to cigarette smoke, as well as polluting the environment.

U.S. Pat. Nos. 4,694,841; 4,774,970; 4,854,331; and 5,179,966 disclose various tobacco smoking devices. The '841 patent is a system for self lighting cigarettes using substances which react with each other, the '970 patent discloses a device which includes a conventional gas lighter, the '331 patent discloses a smoking article wherein a carbonaceous fuel element is used to heat a tobacco flavor medium, and the '966 patent discloses a smoking article which utilizes an electrically heated element to heat a tobacco flavor medium. Another type of smoking device is disclosed in European Patent Publication No. 858744 wherein heat from a combusted gas heats a heat exchanger which raises the temperature of a tobacco containing substance to generate tobacco flavor without burning the substance.

U.S. Pat. Nos. 4,233,998 and 5,529,078 disclose smoking devices for smoking cigarettes. The '998 patent is an apparatus including a mounting within a housing for protecting the cigarette from wind and capable of collecting ashes and sparks. The '078 patent relates to a smoker's box for reducing pollution caused by smoking a cigarette. The smoker's box allows the cigarette to be lighted so that smoke generated during both the lighting of the cigarette and during smoking does not pass to the outside atmosphere without first being filtered.

A limitation of several of these smoking systems is that they are not capable of accepting a traditional brand of cigarette, or if they can accommodate such a cigarette, they do not extinguish the cigarette after each puff. As a result, some previously known smoking systems waste tobacco by producing side stream smoke. Further, by continuously keeping the cigarette lit, previously known smoking devices are a potential fire hazard. Accordingly, it would be desirable if a cigarette smoking apparatus were available which obviates the disadvantages of the previously known smoking devices. It would also be desirable if the housing of such a cigarette smoking apparatus could be designed to catch and contain the ashes generated during the smoking of the cigarette.

SUMMARY OF THE INVENTION

Generally speaking, the present invention provides a puff-on-demand cigarette smoking apparatus for decreasing unnecessary tobacco burning, as well as decreasing the generation of side stream smoke. The portable cigarette smoking apparatus can be used to smoke traditional brands of cigarettes and includes a reusable lighter box housing including an aperture into which a distal end of the cigarette is adapted to be inserted into and removed from. After the cigarette is inserted through the aperture, the cigarette is directed into a cigarette extinguishing sleeve. The cigarette smoking system includes an actuable trigger which is operably connected to a heat source for activating the heat source upon actuation of the trigger to temporarily provide heat to light the cigarette, thereby allowing a smoker to take a puff from the proximal end of the cigarette. At the end of a puff, the cigarette extinguishing sleeve self-extinguishes the cigarette.

In a preferred embodiment, the trigger of the smoking apparatus is operably connected to a cigarette advancing mechanism for advancing the cigarette a preset distance along the cigarette extinguishing sleeve into the lighter box housing upon an actuation of the trigger. As a result, a portion of the cigarette is advanced beyond the cigarette extinguishing sleeve so that the heat source provides heat to an exposed portion of the cigarette.

BRIEF DESCRIPTION OF THE DRAWINGS

The invention will now be described in more detail with reference to preferred embodiments of the invention, given only by way of example, and with reference to the accompanying drawings, in which.

DESCRIPTION OF THE PREFERRED EMBODIMENTS

The invention provides a puff-on-demand cigarette smoking apparatus. Generally, when a cigarette is smoked in a conventional manner, the cigarette is continuously burned and a typical smoker only occasionally takes a puff from the cigarette. As a result, a smoker will only consume a relatively small portion of the cigarette and the rest of the tobacco is unnecessarily burned and wasted. The cigarette smoking apparatus of the present invention aims to eliminate the unnecessary burning of tobacco which usually occurs during the smoking of a cigarette and aims to reduce side stream smoke. Moreover, it is desirable for the smoking apparatus to be a lightweight and hand-held consumer product. The invention achieves such goals by providing a portable puff-on-demand smoking apparatus which can be actuated by a smoker whenever a puff from the cigarette is desired, but otherwise extinguishes the cigarette so that it is not continuously burned.

Figure 1:
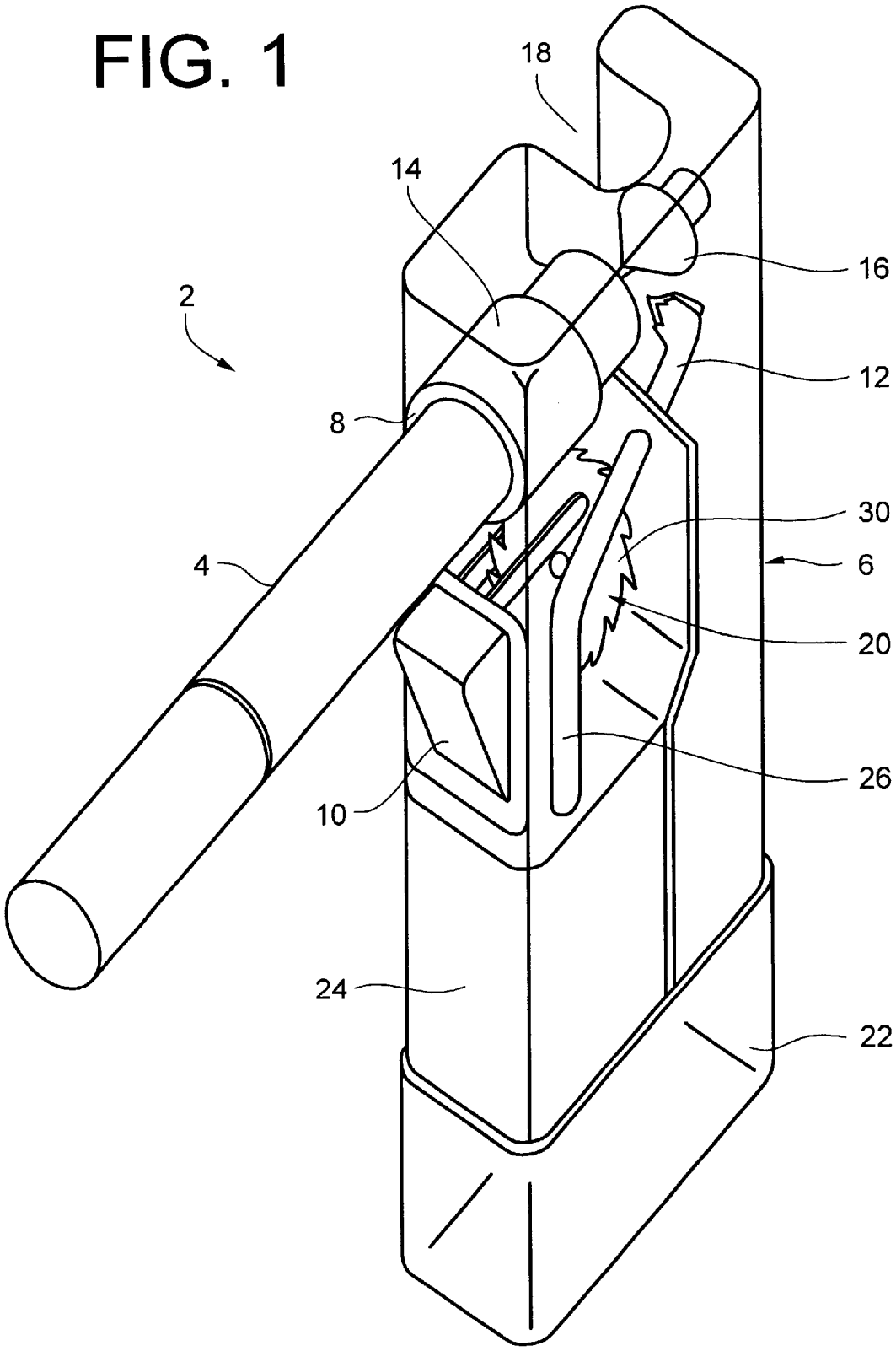
FIG. 1 is a perspective, partially broken away view of a portable smoking apparatus in accordance with a first embodiment of the present invention.

FIG. 1 shows a first embodiment of a portable smoking apparatus 2 in accordance with the present invention. The smoking apparatus 2 can be used with a traditional cigarette 4 and includes a reusable lighter box housing 6. The distal end of the cigarette 4 is adapted to be inserted into and removed from a circular aperture 8 located on a side face of the lighter box housing 6. After being inserted into the aperture 8, the cigarette 4 is directed into a cigarette extinguishing sleeve 14 such that the distal end of the cigarette is substantially flush with a back end of the sleeve 14. In order to consistently achieve the proper insertion depth, the cigarette 4 can be marked to provide the smoker a visual indication that the proper depth of insertion into the sleeve 14 has been reached. Alternatively, a stop can be provided to limit the insertion depth or the smoker can insert the cigarette without use of insertion limiting features.

After inserting the cigarette 4 into the lighter box housing 6, the cigarette can be smoked in the following manner. First, the smoker depresses a trigger 10 located on a side of the lighter box 6 which advances a portion of the cigarette 4 beyond the cigarette extinguishing sleeve 14 and actuates a heat source 12 to provide a controlled pulse of heat, such as an ignited quantity of gaseous butane, to the exposed portion of the cigarette. After each puff, the cigarette extinguishing sleeve 14 is effective to extinguish the cigarette 4 by way of oxygen starvation, thereby conserving the tobacco and reducing the amount of side stream smoke. When another puff is desired, the smoker depresses the trigger 10 again, whereby the cigarette 4 is advanced through the cigarette extinguishing sleeve 14 and another pulse of heat is applied to the newly exposed portion of the cigarette 4 by the heat source 12.

The smoking apparatus 2 of the present invention is designed to sequentially advance the cigarette 4 into the lighter box housing and thus provide a puff of smoking enjoyment to the smoker upon each actuation of the trigger 10. For example, trigger actuation can be repeated approximately eight times until no more of the tobacco rod of the cigarette 4 is available for smoking. At the conclusion of smoking, the filter or proximal end of the cigarette 4 can be removed from the lighter box housing 6 and discarded.

The reusable lighter box housing 6 includes a hand-held housing having a number of components. For instance, the aperture 8 that receives the cigarette 4 is located at a front end of the cigarette extinguishing sleeve 14. The cigarette extinguishing sleeve 14 is supported within the lighter box housing 6. The portion of the cigarette to be combusted extends beyond the distal end of the sleeve 14 and the generated soft ashes formed by combusting the exposed portion of the cigarette can be dislodged and discarded by an ash removing member 16. The ash removing member 16 is illustrated as being generally cone-shaped with the point of the cone directed towards the cigarette 4 for efficiently discarding the soft ashes. However, it is to be understood that the ash removing member 16 can possess other shapes and configurations, so long as the ash removing member 16 is capable of dislodging and removing the ashes. The ash removing member 16 is supported by the housing 6 and can also be arranged to act as a stop for limiting insertion of the cigarette 4 into the reusable lighter box housing 6. During smoking, the smoker draws on the protruding proximal end of the cigarette 4 and ambient air is admitted into the smoking unit through an air flow portal 18 located on the lighter box housing 6. As the smoker continues to draw on the cigarette, air admitted through the air flow portal 18 passes through the combusted portion of the cigarette and mixes with the flavors evolved from the burning tobacco.

Whenever the smoker is ready to take a puff, the trigger 10 is momentarily depressed and a portion of the cigarette is combusted, whether or not the trigger is released. The depression of the trigger 10 thus activates a cigarette advancing mechanism 20 as well as the heat source 12 in a manner as will be described. The cigarette advancing mechanism 20 advances the cigarette a pre-set distance into the lighter box housing 6. For example, the pre-set distance can be approximately 8 mm, as measured from the distal end of the extinguishing sleeve 14 to the distal end of the cigarette 4. The distal end of the cigarette 4 is thus moved into a position where an exposed portion of the cigarette can directly receive a pulse of heat from the heat source 12.

After the cigarette is advanced, the heat source 12 is activated to combust the exposed portion of the cigarette 4, thereby allowing the smoker to take a puff from the lit cigarette. At the end of a puff, the combusted portion of the cigarette 4 self-extinguishes at the end of the extinguishing sleeve section 14, i.e., the sleeve 14 surrounds the cigarette and prevents combustion from continuing along the cigarette due to oxygen starvation. The sleeve 14 is illustrated as being generally cylindrical in shape. However, it is to be understood that the cigarette extinguishing sleeve 14 can possess other shapes and configurations, so long as the sleeve 14 is appropriately configured to self-extinguish the cigarette. At this point, upon being advanced by redepressing the trigger 10, the remaining cigarette 4 is ready for the next puff.

Whenever the smoker is ready to take another puff, the trigger 10 is depressed again, re-activating the cigarette advancing and combustion functions of the portable smoking apparatus. In addition, as the cigarette 4 is advanced, the soft ashes formed by combusting the exposed portion of the cigarette 4 are disintegrated and removed by contact with the cigarette ash removing head section 16. Over time, the soft ashes are accumulated within a removable ash collection section 22 which is releasably attached to the bottom side of the lighter box housing 6. The ash collection section 22 can be made from a transparent material giving the smoker the ability to readily check the status of the accumulated ashes. When necessary, the removable ash collection section 22 can be detached from the lighter box housing 6 and the accumulated ashes emptied from the ash collection section 22.

The cigarette advancing mechanism 20 operates to advance the cigarette 4 a preset distance into the lighter box housing 6. For example, in a first embodiment, as shown in FIG. 1, the cigarette advancing mechanism 20 includes a rotary toothed blade 30 operably connected to the trigger 10. The rotary toothed blade 30 moves a preset angular distance upon each actuation of the trigger 10. The teeth of the rotary toothed blade 30 engage the cigarette 4 through a slot (not shown) extending longitudinally through the cigarette extinguishing sleeve 14 and the teeth operate to move the cigarette along the cigarette extinguishing sleeve 14 as the rotary toothed blade 30 is rotated.

Figure 2:
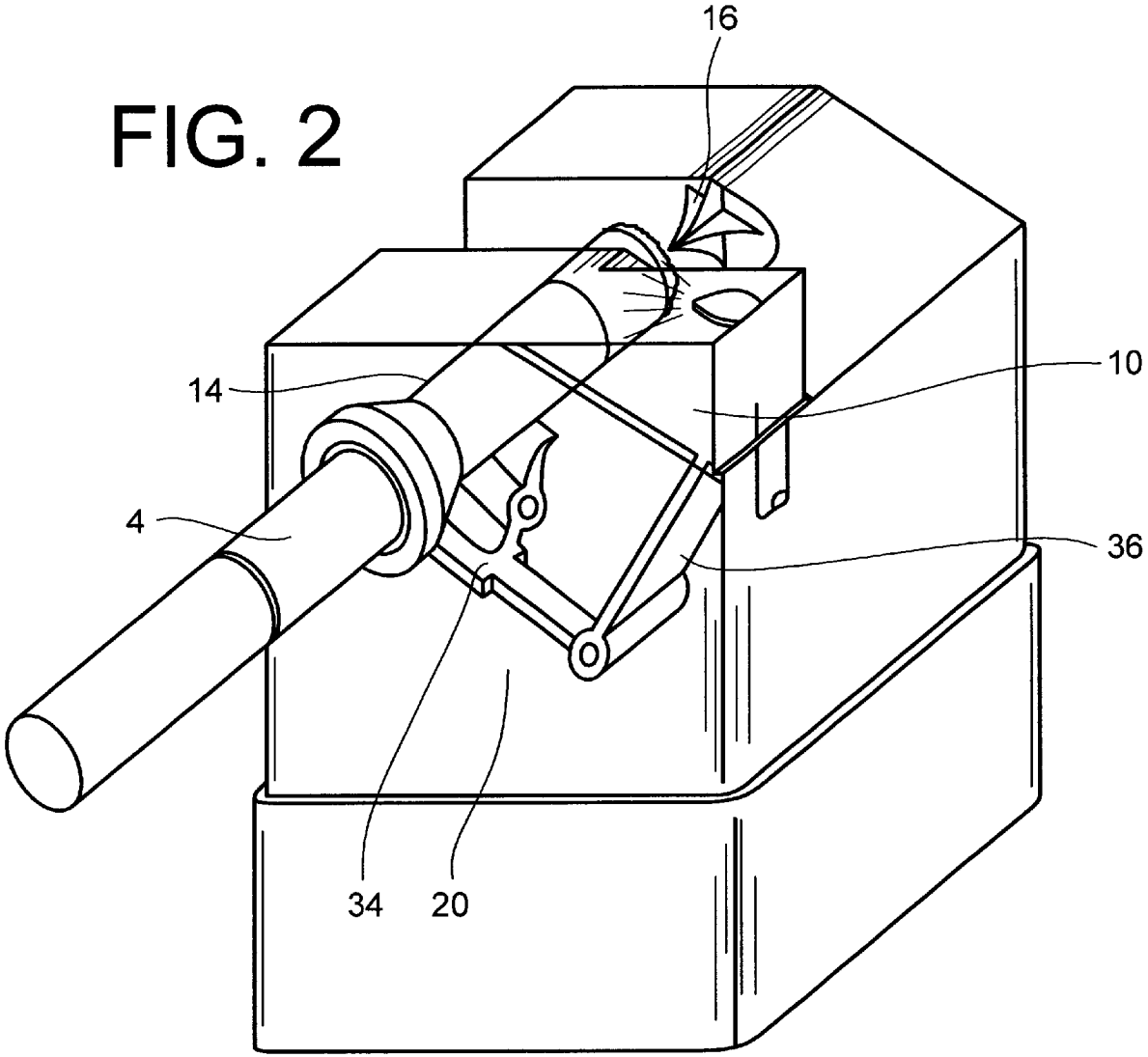
FIG. 2 is a perspective, partially broken away view of a portable smoking apparatus in accordance with a second embodiment of the present invention including an alternative variant of the cigarette advancing mechanism.

In an alternative embodiment, as shown in FIG. 2, the cigarette advancing mechanism 20 includes a hook 34 operably connected to the trigger 10 by way of a lever 36 and a gear (not shown). When a cigarette 4 is inserted into the smoking apparatus, the hook 34 engages the cigarette 4 through a slot (not shown) extending longitudinally through the cigarette extinguishing sleeve 14. In this position, the hook 34 is ready to move the cigarette 4 along the cigarette extinguishing sleeve 14 when the trigger 10 is actuated. Upon actuation of the trigger 10, the lever 36 swings in a downward direction, thereby rotating the gear which rotates the hook 34 a preset angular distance upon each actuation of the trigger 10. The rotation of the hook 34 moves the cigarette 4 along the cigarette extinguishing sleeve 14. Preferably, the hook 34 is rotated through a 90° angle upon each actuation. After releasing the trigger 10, the hook 34 is returned to the initial starting position.

Although two preferred embodiments of the cigarette advancing mechanism 20 have been shown, the cigarette advancing mechanism 20 can include any suitable arrangement which can operate to advance the cigarette 4 a pre-set distance into the lighter box housing 6. In addition, if by accident the cigarette 4 were to be improperly inserted such that the distal end of the cigarette 4 extends beyond the back end of the sleeve 14, it is contemplated that the cigarette advancing mechanism could incorporate a slip mechanism to prevent the cigarette 4 from being further advanced once it comes into contact with the ash removing member 16.

The heat source 12 operates to heat the distal end of the cigarette 4 to a temperature for combusting the tobacco of the cigarette. In a first embodiment, as illustrated in FIG. 1, the heat source 12 includes a fuel reservoir 24, a fuel line 26 and any conventional type of ignitor capable of igniting the fuel upon actuation of the trigger 10. The fuel source can include any type of ignitable fuel which can safely and readily ignite and burn tobacco, such as butane.

Figure 3:
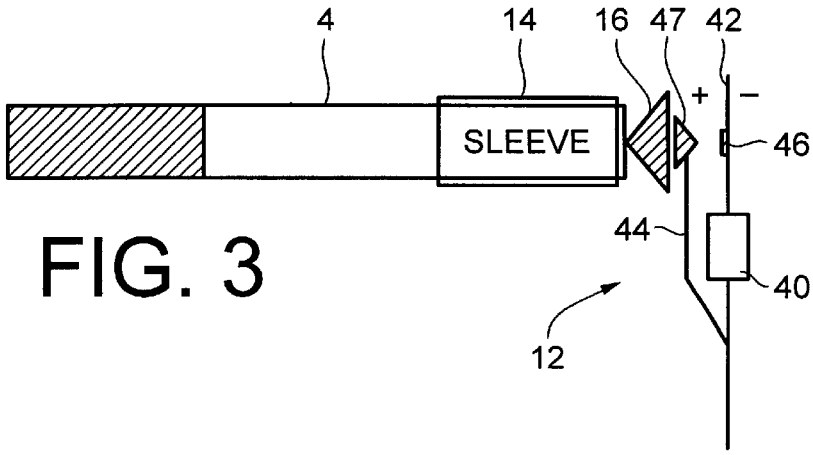
FIGS. 3–5 are schematic diagrams of another embodiment of the portable smoking apparatus of the present invention including an alternative variant of the heat source section.
Figure 4:
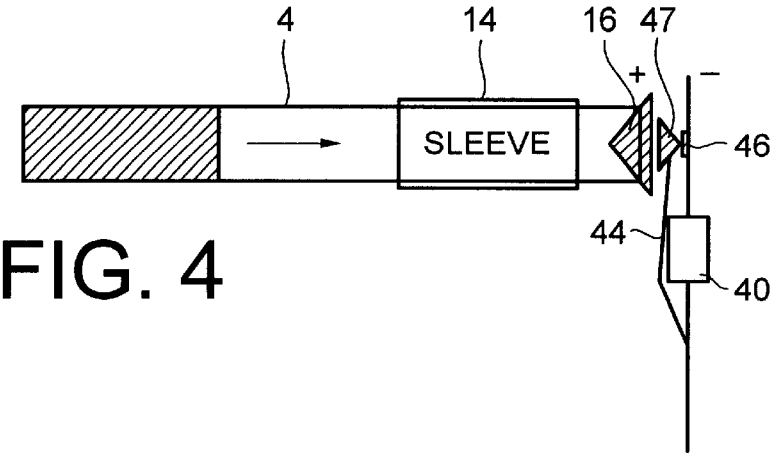
Figure 5:
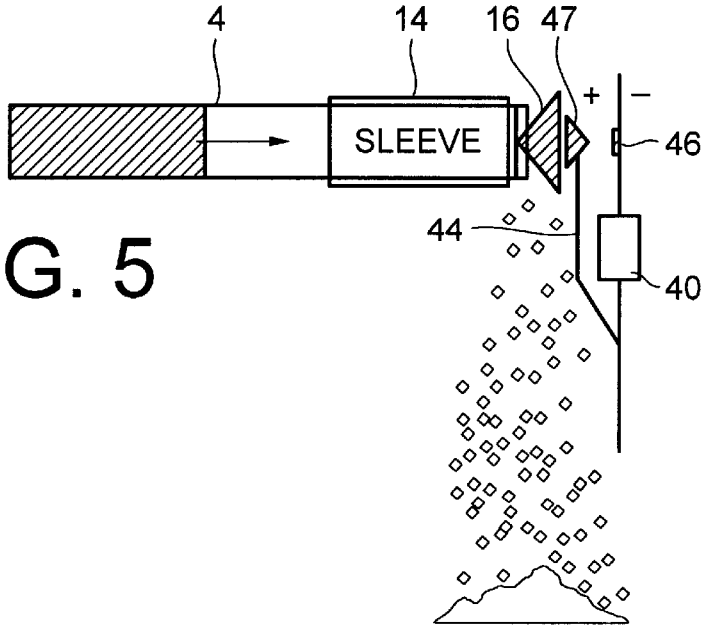

An embodiment of an electrical heat source 12 is illustrated in FIGS. 3–5 wherein an electrical resistance heater imparts heat to an exposed distal end of the cigarette 4 upon actuation of the trigger 10. The embodiment of FIGS. 3–5 incorporates the use of a stored energy cell 40 such as a battery in a circuit 42 for applying resistance heat through the ash removing section 16 to the end of the cigarette 4. In other words, the ash removing section can be used to heat the cigarette in the same was as an automobile lighter.

As seen in FIG. 3, the cigarette 4 is schematically shown in an operative starting position within the lighter box housing (not shown). In the starting position, the cigarette 4 has been inserted into the cigarette extinguishing sleeve 14 such that the distal end of the cigarette is substantially flush with the distal end of the sleeve 14. Furthermore, the distal end of the cigarette 4 is in contact with the ash removing section 16 which is shown in an unactuated position. The ash removing section 16 is movably supported to the housing by way of a flat spring 44 such that in its relaxed condition, the ash removing section 16 is spaced away from an electrical contact 46 situated on or near the lighter box housing.

Referring to FIG. 4, after the trigger is actuated by the smoker, the cigarette advancing mechanism 20 (not shown) operates to advance the cigarette 4 along the cigarette extinguishing sleeve 14 such that the distal end of the cigarette moves a movable contact 47 attached to the ash removing member 16 from the unactuated position into engagement with the electrical contact 46. When the ash removing section 16 engages the electrical contact 46, an electrical circuit is completed and the ash removing member 16 is resistively heated by the power stored in energy cell 40 to a temperature which lights the cigarette 4. In this embodiment of the heat source, the ash removing member 16 is made from a thermally conductive material and the movable contact 47 is made from an electrically conductive material of appropriate resistivity which is readily heated when electric current of the circuit 42 passes through contact 47. Alternatively, the current from circuit 42 could pass through a coil of resistance heating wire incorporated in contact 47. While two embodiments of a resistive heat source have been explained above, the desired heating of the cigarette by a resistive element could be achieved by any suitable mechanism.

Referring to FIG. 5, after the cigarette is lit and the smoker takes a puff from the proximal end of the cigarette, any generated soft ashes can be dislodged by the ash removing member 16. The ash removing member 16 is biased to move in a direction corresponding to the unactuated position by way of the elasticity of the flat spring 44, thereby disengaging the electrical contact 46 and forcing the ash removing member 16 into contact with the soft ashes. The ash removing member 16 dislodges the soft ashes which fall by the force of gravity and accumulate in the ash collection section of the smoking apparatus. As in the embodiment illustrated in FIG. 1, the ash removing member 16 is shown as a generally cone-shaped member, but it is contemplated that it could possess other shapes and configurations.

Although the foregoing embodiments have been described with reference to the preferred use of traditional brands of cigarettes, the smoking apparatus of the present invention can be adapted for use with non-traditional cigarettes or with tobacco or non-tobacco substitutes which have been shaped to form a cigarette, as would be apparent to one of ordinary skill in the art. Other forms of tobacco include cigarette blends, reconstituted tobacco or the like. For example, the tobacco can comprise a combination of one or more of the following: reconstituted tobacco, cut tobacco, and expanded tobacco. Furthermore, the tobacco can be smoked in various forms such as a cylindrical shell of reconstituted tobacco, which can be hollow or partially or completely filled with a tobacco, as described in greater detail in commonly assigned, U.S. Pat. Nos. 5,388,594 and 5,505,214, the disclosures of which are hereby incorporated by reference.

While this invention has been illustrated and described in accordance with several preferred embodiments, it is recognized that variations and changes may be made therein without departing from the invention as set forth in the claims.

What is claimed is:

1. A puff on demand cigarette smoking apparatus comprising:

a housing including an aperture;

an oxygen depletion member supported by the housing and positioned to surround a portion of a cigarette inserted through the aperture;

an igniter supported by the housing and positioned to ignite a distal end of the cigarette inserted a preset distance into the aperture;

a manually operated actuator operably connected to the igniter so as to light the distal end of the cigarette and allow a smoker to take a puff from a proximal end of the cigarette;

wherein the oxygen depletion member extinguishes the burning cigarette after a portion of the cigarette is smoked by the smoker; and a cigarette advancing mechanism which includes a movable cigarette engaging member, the cigarette engaging member being effective to move the cigarette a preset distance into the housing.

2. The cigarette smoking apparatus of claim 1, wherein the pre-set distance is approximately 8 mm.

3. The cigarette smoking apparatus of claim 1, further comprising an ash removing member which dislodges ashes on the distal end of the cigarette.

4. The cigarette smoking apparatus of claim 3, wherein the igniter provides a limited amount of heat to light the cigarette.

5. The cigarette smoking apparatus of claim 4, wherein the igniter ignites a fuel upon actuation of the actuator.

6. The cigarette smoking apparatus of claim 5, wherein the fuel is butane.

7. The cigarette smoking apparatus of claim 1, wherein the cigarette engaging member comprises a rotary toothed blade which engages the cigarette.

8. The cigarette smoking apparatus of claim 1, wherein the cigarette engaging member comprises a hook which runs through a slot in the housing.

9. The cigarette smoking apparatus of claim 1, wherein the oxygen depletion member comprises a sleeve which surrounds the cigarette.

10. The cigarette smoking apparatus of claim 1, wherein the actuator is actuable from an outside of the housing.

11. The cigarette smoking apparatus of claim 1, wherein the oxygen depletion member comprises a cylindrical sleeve.

12. The cigarette smoking apparatus of claim 3, wherein the housing includes a removable ash collection section wherein ashes from the cigarette are collected.

13. The cigarette smoking apparatus of claim 12, wherein the removable ash collection section is made from a transparent material.

14. The cigarette smoking apparatus of claim 3, wherein the housing includes an air flow portal through which ambient air flows and supports combustion of the cigarette when a smoker takes a puff from the proximal end of the cigarette.

15. The cigarette smoking apparatus of claim 3, wherein the actuator can be actuated at least 6 times to sequentially smoke the cigarette inserted into the smoking apparatus.

16. The cigarette smoking apparatus of claim 3, wherein the ash removing member is cone-shaped.

17. The cigarette smoking apparatus of claim 4, wherein the igniter comprises a resistance heating element.

18. The cigarette smoking apparatus of claim 17, wherein the igniter is activated by contact with the cigarette when the actuator effects movement of the cigarette.

19. The cigarette smoking apparatus of claim 18, further comprising an ash removing member which is biased towards the distal end of the cigarette.

20. The cigarette smoking apparatus of claim 19, wherein the ash removing member is mounted on a spring.

21. The cigarette smoking apparatus of claim 18, wherein the ash removing member is cone-shaped.

22. The cigarette smoking apparatus of claim 18, wherein the ash removing member is made from an electrically conducted material.

23. The cigarette smoking apparatus of claim 11, wherein when a cigarette is inserted, a portion of the distal end of the cigarette extends through and beyond the cylindrical sleeve.

* * * * *